United States Patent [19]

Shimamura

[11] Patent Number: 4,479,472

[45] Date of Patent: Oct. 30, 1984

[54] APPARATUS AND METHOD FOR CORRECTING THE THROTTLE OPENING FOR AUTOMOTIVE ENGINES PARTICULARLY AFTER STARTING OF THE ENGINES

[75] Inventor: Haruo Shimamura, Kawashima, Japan

[73] Assignee: Honda Giken Kogyo Kabushiki Kaisha, Tokyo, Japan

[21] Appl. No.: 344,723

[22] Filed: Feb. 1, 1982

[30] Foreign Application Priority Data

Feb. 10, 1981 [JP] Japan ..... 56-18556

[51] Int. Cl.[3] ..... F02D 11/06

[52] U.S. Cl. ..... 123/340; 123/179 A; 123/339; 123/401

[58] Field of Search ..... 123/339, 340, 341, 395, 123/396, 399, 401, 179 A, 179 B, 389; 180/54 G

[56] References Cited

U.S. PATENT DOCUMENTS

| | | | |
|---|---|---|---|
| 3,960,130 | 6/1976 | Peterson, Jr. | 123/179 A |
| 4,144,853 | 3/1979 | Maruoka et al. | 123/339 |
| 4,237,838 | 12/1980 | Kinugawa et al. | 123/339 |
| 4,312,311 | 1/1982 | Iwata | 123/339 |
| 4,321,900 | 3/1982 | Takeda | 123/339 |
| 4,346,686 | 8/1982 | Wakita et al. | 123/339 |
| 4,369,755 | 1/1983 | Saito | 123/339 |
| 4,391,246 | 7/1983 | Kawabata et al. | 123/340 |

FOREIGN PATENT DOCUMENTS

| | | | |
|---|---|---|---|
| 55-5437 | 1/1980 | Japan | 123/339 |

*Primary Examiner*—Andrew M. Dolinar

*Attorney, Agent, or Firm*—Posnack, Roberts, Cohen & Spiecens

[57] ABSTRACT

Apparatus for preventing undesirable reduction in the speed of an engine after starting and including an actuator operable upon engine starting to correct throttle opening to a determined extent in increasing direction, a vacuum power system for the actuator and a switching control circuit for detecting engine starting and predetermined running states of the vehicle and engine to keep the actuator energized as long as the engine speed and the vehicle speed are both below respective preset level. Even after the preset level of vehicle speed has been exceeded, the actuator is also energized in the presence of battery load, such as air conditioning or headlights when the engine speed remains below its preset level. The actuator is de-energized when the vehicle speed exceeds its preset level in the absence of battery load as well as when the preset level of engine speed is exceeded.

14 Claims, 1 Drawing Figure

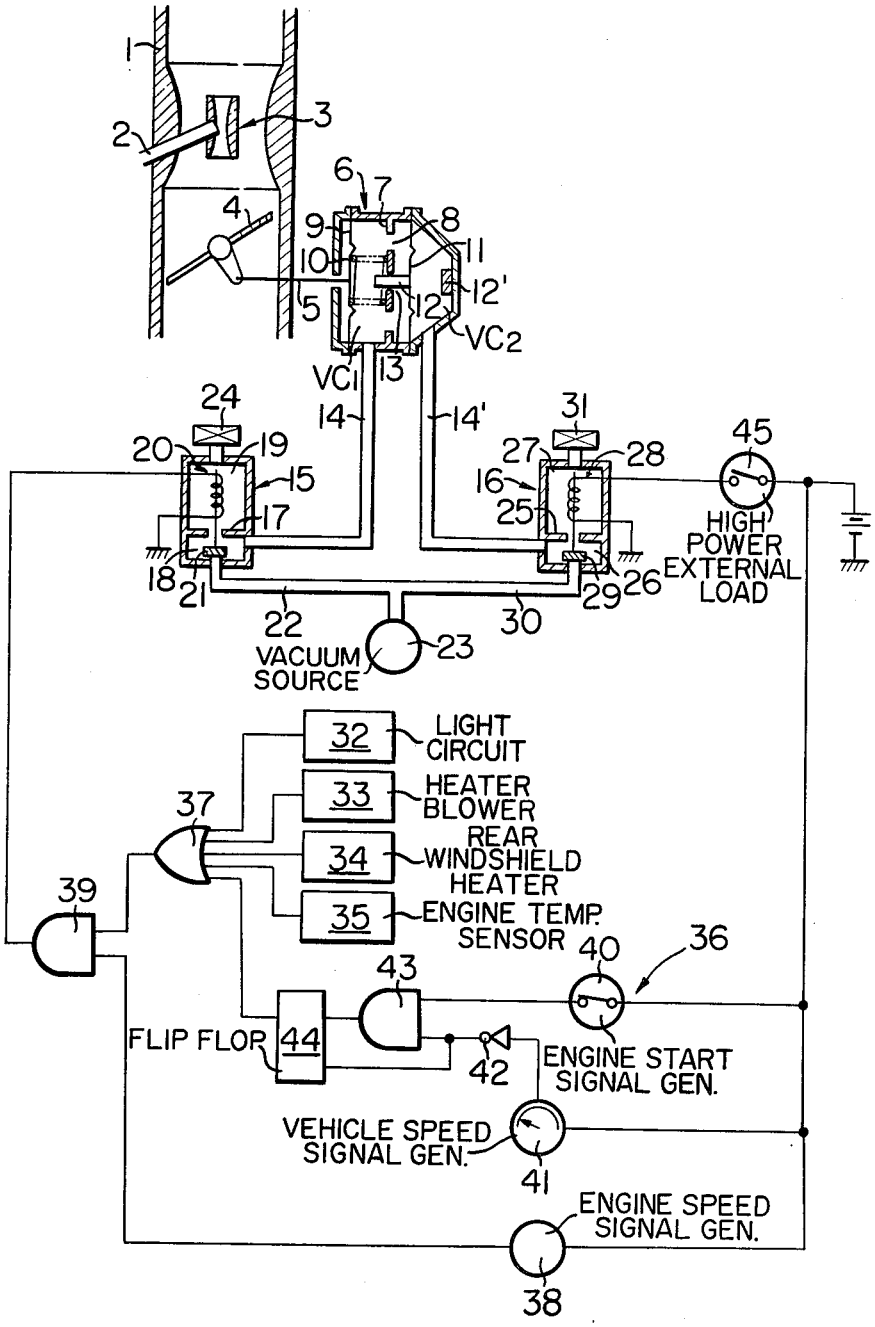
1
2
3
4
5
6
7
8
9
10
11
12
12'
13
VC1
VC2
14
14'
15
16
17
18
19
20
21
22
23
24
25
26
27
28
29
30
31
VACUUM SOURCE
45
HIGH POWER EXTERNAL LOAD
32
LIGHT CIRCUIT
33
HEATER BLOWER
34
REAR WINDSHIELD HEATER
35
ENGINE TEMP. SENSOR
36
37
38
39
40
41
42
43
44
FLIP FLOP
ENGINE START SIGNAL GEN.
VEHICLE SPEED SIGNAL GEN.
ENGINE SPEED SIGNAL GEN.

APPARATUS AND METHOD FOR CORRECTING THE THROTTLE OPENING FOR AUTOMOTIVE ENGINES PARTICULARLY AFTER STARTING OF THE ENGINES

FIELD OF THE INVENTION

This invention relates to throttle-opening correcting apparatus for automotive engines of the type adapted to automatically correct the opening of the throttle valve of the engine after starting in increasing direction and to keep the opening so corrected at least until the speed (r.p.m.) of the engine or the running speed of the vehicle exceeds a preset level. The invention also relates to associated methods of control and operation.

PRIOR ART

Known in the art is apparatus of the above type adapted not only to maintain the speed of the engine during idling in a relatively low range for reduction of fuel consumption but also to correct the throttle opening in increasing direction during the low speed engine operation thereby to prevent reduction in engine speed which usually occurs when an external load, such as an air conditioner compressor or headlights are activated and draw power from the vehicle battery.

On the other hand, generally, upon starting an automotive engine, the battery is discharged to drive the engine starter motor and, after the engine has been started, the generator associated with the engine is driven to charge the battery. It has been conventional that the idling speed of the engine is more or less reduced, causing an undesirable feeling in the driver, despite the use of the throttle correcting device.

SUMMARY OF THE INVENTION

An object of the present invention is to provide a unique throttle-opening correcting device for automotive engines adapted to automatically correct the opening of the throttle valve in increasing direction and to keep the opening so corrected independently of the external load condition of the engine at least until the vehicle speed or the engine speed exceeds a preset level and thereby is effective to prevent any reduction in engine speed during the entire period.

The above and other objects and advantages of the present invention will become apparent with reference to the following description taken in conjunction with the accompanying drawing.

BRIEF DESCRIPTION OF THE DRAWING

In the drawing, the sole FIGURE is a schematic cross-sectional view of a throttle-opening correcting device embodying the principles of the invention and explanatory of its controlling circuit arrangement.

DESCRIPTION OF THE PREFERRED EMBODIMENT

In the drawing, which illustrates a preferred embodiment of the invention, there is seen a portion of a carburetor 1 which includes a venturi tube 3 with a fuel nozzle 2 opening therein and a throttle valve 4 arranged at the downstream side thereof. The valve 4 is connected by a rod 5 to an actuator 6 so that the throttle opening of valve 4 is correctable under the control of the actuator. In the actuator 6 is a fixed partition wall 7 which is provided with communicating holes 8. A diaphragm 9 is arranged in the actuator 6 in front of the partition wall

7 i.e. the left-hand side thereof, as viewed in the drawing, and is connected to the rod 5. Arranged behind the partition wall 7 is a second diaphragm 11. A return spring 10 is arranged between the first diaphragm 9 and fixed wall 7 such that, as long as a chamber $VC_1$ defined between the first and second diaphragms 9 and 11 is held at atmospheric pressure, the diaphragm 9 remains in a position not to act upon the throttle valve 4 for any correction of its opening. A movable stop member 12 is fixed at its base end to the center of second diaphragm 11 and extends forwardly beyond the fixed partition wall 7 through a hole 13 formed in the wall 7 centrally thereof for movement with the second diaphragm 11 relative to the fixed wall 7. As will readily be noted, whenever the chamber $VC_1$ between the first and second diaphragms 9 and 11 is placed under vacuum, the first diaphragm 9 is deformed to make contact with the forward end of the movable stop part 12 and, accordingly, the opening of the throttle valve 4 is corrected to a particular or definite extent in increasing direction. Arranged behind the second diaphragm 11 is a fixed stop 12' therefor and, as long as a chamber $VC_2$ defined in the actuator casing behind the second diaphragm 11 is held at atmospheric pressure, the diaphragm 11 remains in a position spaced from the fixed stop 12', as shown. On the other hand, when the chamber $VC_2$ behind the second diaphragm 11 is placed under vacuum, the diaphragm 11 is flexed rearwardly toward the fixed stop 12' and accordingly the movable stop 12 on the diaphragm 11 is retracted to increase the extent to which the opening of throttle valve 4 is correctable in increasing direction.

As illustrated, the chamber $VC_1$ defined in the actuator casing between the two diaphragms 9 and 11 is in communication through a pipe 14 with a chamber 18 defined in a switching control 15 and connected through a pipe 22 to a vacuum source 23, for example, the intake manifold of the engine. Also defined in the switching control 15 is another chamber 19 which is separated from the chamber 18 by a partition wall 17, which is provided with a valve aperture centrally thereof. The second chamber 19 is in communication with the external atmosphere through an air filter 24. Arranged in the first chamber 18 is a valve element 21 which is actuatable by an electromagnetic solenoid 20 arranged in the second chamber 19. As long as the solenoid 20 remains idle or deenergized, the valve element 21 is in its lower, normal position, as shown, and the valve aperture in the partition wall 17 remains open. During this time, the chamber $VC_1$ defined in the actuator casing between the two diaphragms 9 and 11 is held at atmospheric pressure, communicating with the atmosphere through pipe 14, chambers 18 and 19 of switching control 15 and air filter 24. On the other hand, when the solenoid 20 is energized, the valve element 21 is raised to close the valve aperture in the partition wall 17 with the result that the actuator chamber $VC_1$ between the two diaphragms 9 and 11 is placed in communication solely with the vacuum source 23 through pipe 14, first chamber 18 and pipe 22 and thus is placed under vacuum.

The rear chamber $VC_2$ defined in the actuator 6 behind the second diaphragm 11 is in communication through a pipe 14' with a chamber 26 defined in another switching control 16 and chamber 26 is connected to the vacuum source 23 by a pipe 30. As in the first switching control 15, another chamber 27 is defined therein which is separated from the first chamber 26 by a partition wall 25 provided with a central valve aperture and chamber 27 is in communication with the atmosphere through an air filter 31. A valve element 29 is arranged in the first chamber 26 while in the second chamber 27 is arranged an electromagnetic solenoid 28 for actuating the valve element 29. As long as the solenoid 28 remains at rest or is de-energized, the valve element 29 is in a position to open the valve aperture in partition wall 25. At this time, the chamber behind the diaphragm 11 is at atmospheric pressure, communicating with the atmospheric through the pipe 14', chambers 26 and 27 of the second switching control 16 and air filter 31. Upon energization of the solenoid 28, the valve element 29 is raised to close the valve aperture in the partition wall 25 with the result that the rear chamber $VC_2$ defined in the actuater 6 behind the second diaphragm 11 is placed in communication solely with the vacuum source 23 through pipe 30 and thus is placed under vacuum.

Referring next to the lower part of the drawing, there are shown in block or schematic form different external loads 32, 33, 34, of relatively small power consumption, such as headlights and parking lights, a heater blower, and a rear windshield heater; a temperature sensor 35 adapted to continuously produce an electrical signal until the started engine is fully warmed, for example, to a temperature of 75° C. or above; and a control signal generator 36 adapted to continue to produce an electrical signal after the engine has been started until the vehicle speed exceeds a predetermined level; all of which components are arranged, as shown, to feed an OR circuit 37 with their electrical signals when in operation. Reference numeral 38 indicates an engine speed responsive signal generator adapted to produce an electrical signal continuously as long as the engine speed remains below a preset level, e.g. 1500 r.p.m. and to cease signal production when the preset level of 1500 r.p.m. is exceeded. The output signals of OR circuit 37 and signal generator 38 are fed to an AND circuit 39, the output of which is connected to the solenoid 20 in the first switching control 15.

The control signal generator 36 includes a start signal generator 40 adapted to produce an electrical signal when the engine is started, for example, in co-operation with a starter switch, a vehicle speed signal generator 41 adapted to produce an electrical signal when the vehicle speed exceeds, for example, 20 km/hr, and an inverter circuit 42 for inversion of the output signal from the vehicle speed signal generator 41, an AND circuit 43 adapted to be fed with the output signal of the engine start signal generator 40 and the output signal of the inverter circuit 42, that is, an inversion of the output signal of vehicle speed signal generator 41, and a flip-flop circuit 44 arranged to be fed with the output signal from the AND circuit 43 and from the inverter circuit 42. The output signal of flip-flop circuit 44, that is, the output signal of the control signal generator 36, is fed to the OR circuit 37 as one of the inputs thereto.

The solenoid 28 in the second switching control 16 is connected, for example, to the output side of an external load 45, such as a compressor of an air conditioner which is rather high in power consumption and, when put in operation, produces an electrical signal for energization of the solenoid 28.

With the arrangement described above, immediately after the starter switch has been turned on to start the engine, when the vehicle speed is below the preset level of 20 km/hr and the engine speed below the preset level of 1500 r.p.m., the AND circuit 39 produces an output signal, irrespective of whether the components 32, 33, 34 and temperature sensor 35 are in operation or not, so that the solenoid 20 in the first switching control 15 is energized to raise the valve element 21 to close the valve aperture formed in the partition wall 17. Accordingly, the chamber $VC_1$ defined in the actuator casing between the two diaphragms 9 and 11 is placed in communication solely with the vacuum source 23, and thus is evacuated with the result that the first diaphragm 9 is deformed into contact with the forward end of movable stop 12 to effect opening of throttle valve 4 in increasing direction.

Subsequently, when the vehicle speed reaches 20 km/hr or more, the output signal of inverter circuit 42 is terminated to reset the flip-flop circuit 44 so that, as long as the components 32, 33, 34 and temperature sensor 35 are out of operation, the output signal of OR circuit 37 is terminated to terminate the output signal of AND circuit 39 thereby to deenergize the solenoid 20, even if the engine speed remains below 1500 r.p.m. As a result, the valve element 21 is released to open the valve aperture in the partition wall 17 and the chamber $VC_1$ defined in the actuator 6 between the two diaphragms 9 and 11 is placed in communication with the atmosphere through pipe 14, chambers 18, 19 in the first switching control 15 and air filter 24 so that the first diaphragm 9 is restored under the bias of return spring 10 to its normal position, thus terminating the throttle correcting function.

On the other hand, even when the vehicle speed has exceeded 20 km/hr, if at least one of the components 32, 33 and 34 or the temperature sensor 35 is brought into operation, the AND circuit 39 produces an output signal to render the throttle opening corrected in increasing direction so that any reduction in engine speed is effectively prevented, as long as the engine speed remains below the preset level of 1500 r.p.m.

Subsequently, however, when the engine speed reaches 1500 r.p.m. or more, the output signal of engine-speed responsive signal generator 38 terminates to terminate the output of AND circuit 39 and from now on no correction is effected on the opening of throttle valve 4.

If, under the condition that the solenoid 20 is in an energized state, i.e. the chamber $VC_1$ defined between the two diaphragms 9 and 11 is in communication solely with the vacuum source 23 to hold the diaphragm 9 against the adjacent end of movable stop 12, the air conditioner compressor or similar external load 45 of high power consumption is put into operation, the solenoid 28 in the second switching control 16 is immediately energized to cause the valve element 29 to close the valve aperture in partition wall 25 thereby to place the chamber $VC^2$ behind the second diaphragm 11 in communication with the vacuum source 23. As a result, the diaphragm 11 is flexed rearwardly displacing the movable stop 12 toward the fixed stop 12', thus allowing the first diaphragm 9 to be further flexed in the rearward direction and the opening of throttle valve 4 is corrected in increasing direction to a further extent.

In the present invention, however, the second switching control 16 may be omitted, if desired. In that case, the second diaphragm 11 assumes the form of a fixed wall with a fixed stop thereon in place of the movable stop 12.

It will be appreciated from the foregoing description that, according to the present invention, a novel throttle-opening correcting device has been realized which is arranged so that, when the engine is started, a throttle actuator is energized to correct the opening of the throttle valve in increasing direction and subsequently, when the engine or the vehicle attains a predetermined running condition, the actuator is rendered inoperative. Accordingly, with this arrangement, once the engine has been started, the throttle opening is held corrected in increased direction until the vehicle speed or the state of engine operation reaches a predetermined level so that any undesirable reduction in rotational speed of the engine, as may otherwise result from load increase, is effectively prevented.

What is claimed is:

1. A throttle-opening correcting apparatus for an automotive engine of a vehicle in which the engine has a throttle valve movable between closed and open positions for controlling engine speed, said apparatus comprising actuator means connected to the throttle valve of the engine for opening the throttle valve in increasing direction to a first corrected state; power means connected to said actuator means for feeding operational power thereto; first detecting means for detecting the state of the started engine and thereupon operative to render said power means operative; second detecting means for detecting a predetermined running state of the vehicle for rendering said power means inoperative, third detecting means for detecting a predetermined engine speed, and means connecting said first, second and third detecting means so that with the predetermined running state of the vehicle not achieved, the power means remains operative and the throttle valve is kept in its first corrected state provided said third detecting means detects engine speed below said predetermined engine speed and when said third means detects engine speed above said predetermined engine speed said power means is rendered inoperative irrespective of the detected running state of the vehicle.

2. Apparatus as claimed in claim 1, in which said first detecting means includes an engine start signal generator means for producing a signal when the engine is started and said second detecting means includes speed signal generator means for producing a signal when vehicle speed exceeds a preset level.

3. Apparatus as claimed in claim 2 wherein said speed signal generator means includes a vehicle speed signal generator.

4. Apparatus as claimed in claim 2 comprising fourth detecting means for detecting the state of selected engine and associated electrical components for rendering said power means operative when engine speed is less than said predetermined engine speed and the fourth detecting means is operative.

5. A throttle-opening correcting apparatus for an automotive engine of a vehicle in which the engine has a throttle valve movable between closed and open positions, said apparatus comprising actuator means connected to the throttle valve of the engine for opening the throttle valve in increasing direction to a first corrected state; power means connected to said actuator means for feeding operational power thereto; first detecting means for detecting the state of the started engine and thereupon operative to render said power means operative; second detecting means for detecting a predetermined running state of the vehicle or the started engine for rendering said power means inoperative, said first detecting means including an engine start signal generator means for producing a signal when the engine is started and said second detecting means includes speed signal generator means for producing a signal when at least one of vehicle speed and engine speed exceeds a preset level; and third detecting means for detecting the state of selected engine and associated electrical components for rendering said power means operative when the engine speed is less than said preset level and the third detecting means is operative, said power means including a power source and an electrical circuit for selectively controlling said power source for operating said actuator means, said electrical circuit including an AND circuit for energizing said actuator means, said speed signal generator means including an engine speed signal generator connected to one input of said AND circuit and a vehicle speed signal generator connected to a second input of said AND circuit.

6. Apparatus as claimed in claim 5 wherein said electrical circuit further comprises a second AND circuit having an output connected to said first AND circuit, said first detecting means being connected to one input of said second AND circuit, said vehicle speed signal generator being connected to a second input of said second AND circuit and thereby to said first AND circuit.

7. Apparatus as claimed in claim 6 wherein said electrical circuit further comprises a flip-flop connected between said first and second AND circuits, and an inverter having an input connected to said vehicle speed signal generator and an output connected to a second input on said second AND circuit and to one input of said flip-flop.

8. Apparatus as claimed in claim 7 wherein said electrical circuit further comprises an OR circuit having an output connected to said second input of said first AND circuit, said flip-flop being connected to one input of said OR circuit, said third detecting means being connected to a further input of said OR circuit.

9. Apparatus as claimed in claim 8 wherein said third detecting means comprises an engine temperature sensor.

10. Apparatus as claimed in claim 5 further comprising means for moving said throttle valve in further inceased direction to a second corrected state in response to application of a predetermined high external power load on the engine and said power means has been rendered operative.

11. Apparatus as claimed in claim 5 wherein said actuator means comprises an actuator rod connected to said throttle valve, said power means comprising a flexible diaphragm connected to said rod, a vacuum chamber acting on said diaphragm to displace said diaphragm and said rod therewith when said chamber is subjected to vacuum, and means for selectively connecting said chamber to vacuum and atmosphere in response to the conditions of said first and second detecting means.

12. Apparatus as claimed in claim 11 comprising stop means for limiting displacement of said diaphragm and thereby of said rod when said vacuum chamber is subjected to vacuum; a second diaphragm supporting said stop means, a second vacuum chamber acting on said second diaphragm to displace said second diaphragm and said stop means therewith for permitting further displacement of said rod and thereby said throttle valve in increasing direction to a more open second state, and means responsive to application of a predetermined relatively high external power load on the engine for supplying vacuum to said second vacuum chamber.

13. A method of controlling throttle-opening of a throttle valve of an automotive engine of a vehicle having a plurality of electrical components, said method comprising displacing the throttle valve of the engine in opening direction to a first corrected state in response to starting of the engine and detection of engine speed below a predetermined value and at least one of said electrical components is energized or engine temperature is below a predetermined value, or vehicle speed is below a predetermined value, cancelling displacement of the throttle valve to said corrected state when engine speed exceeds its predetermined value and returning said throttle valve to said first corrected state when engine speed drops below its predetermined value provided that concurrently at least one of said electrical components is energized or engine temperature is below its predetermined value or vehicle speed is below its predetermined value.

14. A method as claimed in claim 13 comprising displacing the throttle valve to a second corrected state in which the throttle valve is opened wider than in said first corrected state upon application of predetermined high external power load on the engine.

* * * * *